US007244163B2

(12) United States Patent
Benassi

(10) Patent No.: US 7,244,163 B2
(45) Date of Patent: Jul. 17, 2007

(54) TOY CAR KIT

(76) Inventor: Max Benassi, P.O. Box 2016, Rancho Santa Fe, CA (US) 92067

( * ) Notice: Subject to any disclaimer, the term of this patent is extended or adjusted under 35 U.S.C. 154(b) by 0 days.

(21) Appl. No.: 11/077,459

(22) Filed: Mar. 9, 2005

(65) Prior Publication Data

US 2006/0205317 A1 Sep. 14, 2006

(51) Int. Cl.
*A63H 29/24* (2006.01)

(52) U.S. Cl. ..... 446/93; 446/269; 446/289; 446/465; 446/451

(58) Field of Classification Search ..... 446/93–96, 446/409–414, 131–434, 465, 468, 85, 269, 446/270, 273–294
See application file for complete search history.

(56) References Cited

U.S. PATENT DOCUMENTS

| | | | | | |
|---|---|---|---|---|---|
| 3,120,719 | A * | 2/1964 | Simonds | 446/78 |
| 3,202,109 | A * | 8/1965 | Stewart | 104/60 |
| 3,523,388 | A * | 8/1970 | Barlow et al. | 446/409 |
| 3,628,284 | A * | 12/1971 | Soulakis et al. | 446/462 |
| 3,654,727 | A * | 4/1972 | Span et al. | 446/94 |
| 3,797,404 | A * | 3/1974 | Barlow et al. | 104/304 |
| 3,939,600 | A * | 2/1976 | Eid | 446/94 |
| 4,163,341 | A * | 8/1979 | Jones et al. | 446/138 |
| 4,164,090 | A * | 8/1979 | Fischer | 446/95 |
| 6,364,736 | B1 * | 4/2002 | Lee | 446/463 |

* cited by examiner

*Primary Examiner*—Nini F. Legesse
(74) *Attorney, Agent, or Firm*—Paul Davis; Heller Ehrman LLP

(57) ABSTRACT

The present invention relates to a toy car kit comprised of a block or frame, wheels, a motor and electric circuitry to operate the toy vehicle.

1 Claim, 3 Drawing Sheets

TOY CAR KIT

FIELD OF INVENTION

The present invention relates to a toy car kit which children can assemble from parts including a wooden block having axels, wheels, an electric motor, and a drive means to drive the rear wheels.

BACKGROUND OF THE INVENTION

There are a number of science, technology, or engineering toys which are used to interest children, especially in the 8 to 14 year age range, learning the art and science of electric circuits, the mechanics of motors of pulleys and to get them generally interested in science and technology. The present invention allows children to obtain hands-on experience in building a motorized vehicle and hopefully create the beginnings of future automotive engineers and scientists.

SUMMARY OF THE INVENTION

In accordance with one embodiment of the invention, there is provided a wooden block which can hold in place drive shafts and wheels. The wooden block also has means of holding in place an electric motor, a switch and a battery to power the wheels.

Accordingly, one object of the present invention is to allow children to assemble a toy car from parts provided in a kit. Accordingly, there is described herein a toy car kit which children can assemble from parts comprising a wooden block, having first and second axles which are attached to front and rear wheels, a motor having a drive shaft which is held in place by a bracket on the wooden block. The motor has a drive shaft which connects to the rear axel through pulleys and a belt. When the child wants to activate the motor he or she simply activates the switch. The subject invention including the above described embodiment acts as a wonderful learning tool for children along the same lines as soap box derbies and the like.

These and further options and advantages of the present invention will be apparent from the following description, when taken in connection with the accompanying drawings which show for purposes of illustration only several embodiments in accordance with the principles of the present invention.

DETAILED DESCRIPTION

Figure 1:
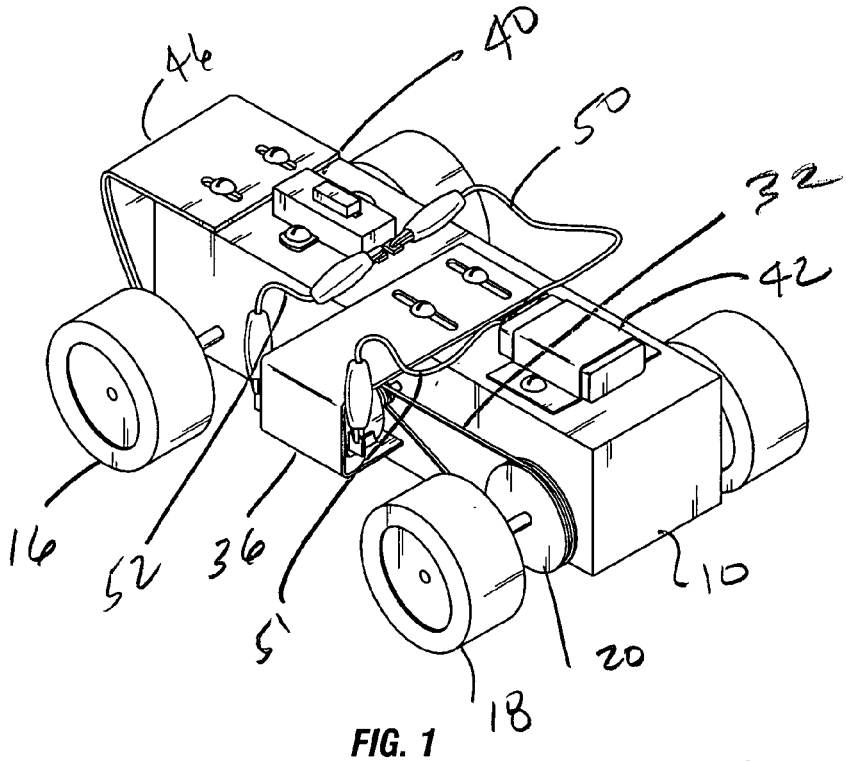
FIG. 1 shows a perspective view of the present invention in its final form.
Figure 8:
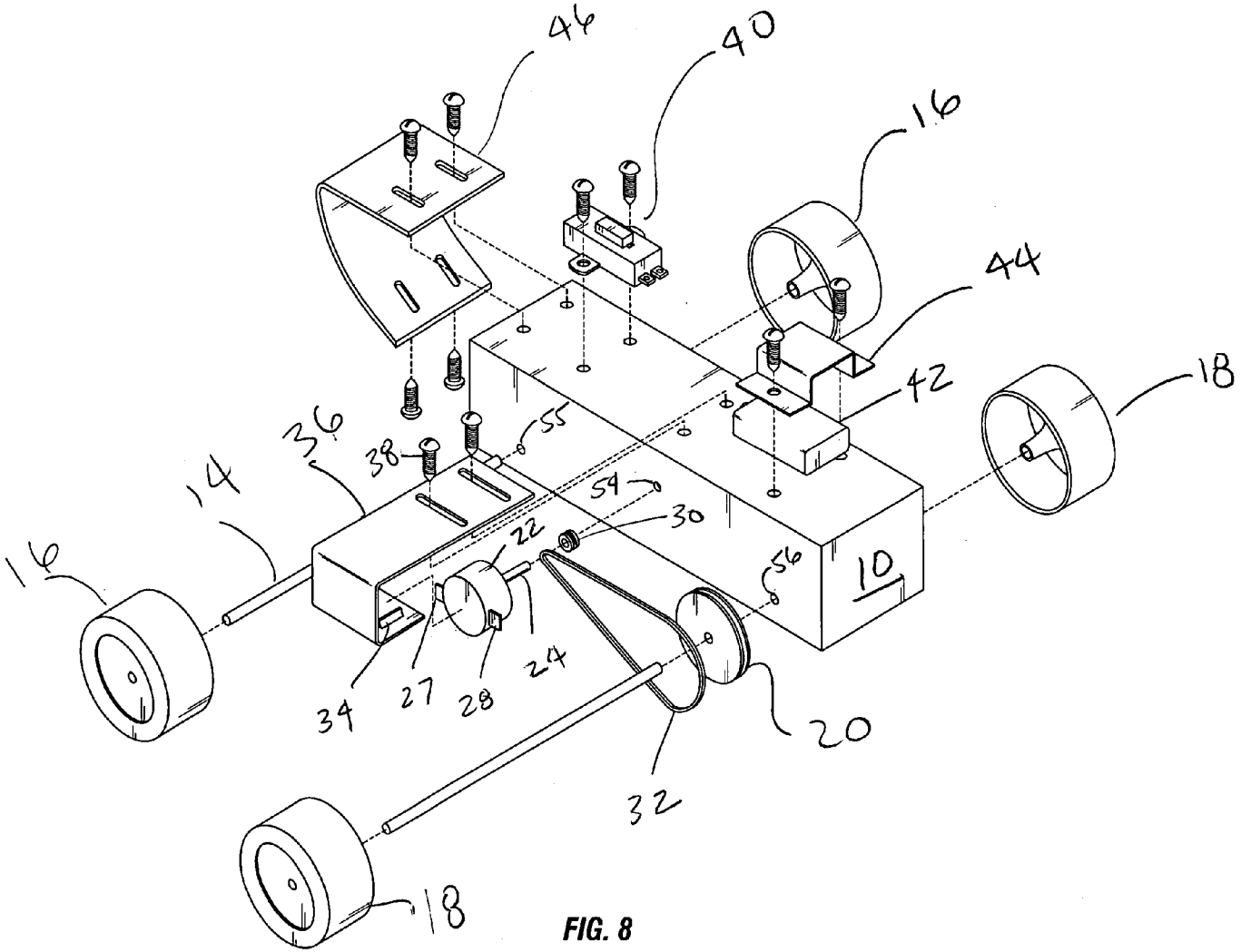
FIG. 8 shows another perspective view of FIG. 1.

Referring to FIG. 1 and FIG. 8 which should be viewed in tandem, the car kit includes a block 10 or frame which, in the preferred embodiment, is typically a wooden block that is commonly sold at hobby stores for building soap box derby cars, the block has holes drilled in it to accommodate front axel 14, and rear axel 12 to which are attached to front wheels 16 and rear wheels 18. The rear axel also has attached to it a driven pulley which is connected through drive belt 32 to the motor 22.

The wooden block 10 also has predrilled holes to accommodate motor mounting bracket 36 which holds motor 22 in place. Motor 22 has a drive shaft 24 to which is attached a driving pulley 30. The combination of drive shaft 24 and driving pulley 30 is then inserted with the drive shaft in hole 54 on the block on one side, and the other side, the motor held in place by motor mounting bracket 36 and tabs 34. Accordingly, the motor is held in place when the drive shaft is inserted in hole 54 and mounting screws 38 are driven in fastening the motor mounting bracket to the wooden block. The motor drive shaft is free to move and is moveably connected to the driven pulley 20 driving the rear wheels. Hole 54 on the block is large enough to allow free spinning of drive shaft 24. Accordingly, the combination motor and drive shaft 24 is held in place by virtue of the drive shaft being inserted in hole 54 on one side and mounting bracket 36 on the other. Motor 22 has positive and negative terminals 26 and 28 to which are attached positive and negative leads 50 and 52 which are provided with the kit. These leads including 51 and 52 are connected in series to the battery 42 and to the switch 40 to allow the child to operate the switch and allow the toy car kit to go forward or backward. Holes 56, 55, 54 and 58 are preferably pre-drilled in the block although another aspect of the invention is to have the block not drilled at all and allow the children to drill their own holes. A separate drill or drill guide can even be provided with the kit.

Figure 2:
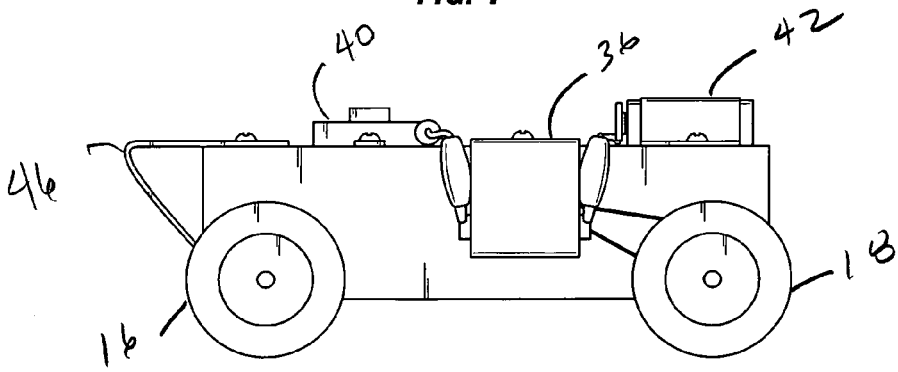
FIG. 2 shows a side view from the side of the motor.

Going to FIG. 2 a side view of the car which is ultimately built is shown. This embodiment also has a fairing 46 that can be attached and also serves as a bumper. Note that in FIG. 2 all of the screws have been driven in.

Figure 3:
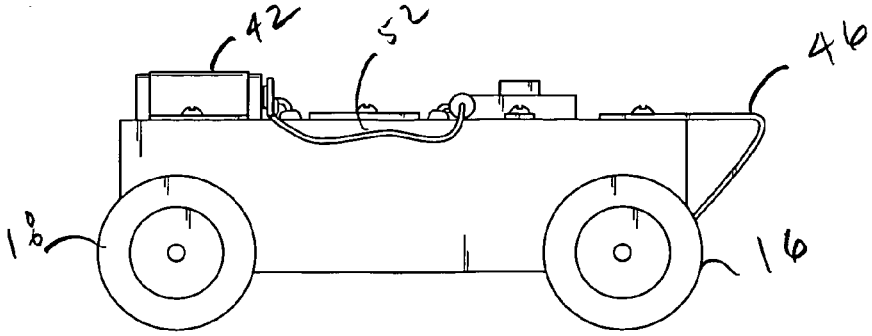
FIG. 3 shows the other side view opposite the motor.

Likewise, FIG. 3 shows another view of the side not including the motor. Connecting line 52 is preferably is a standard lead or connection wire with alligator clips which make it much easier to assemble.

Figure 4:
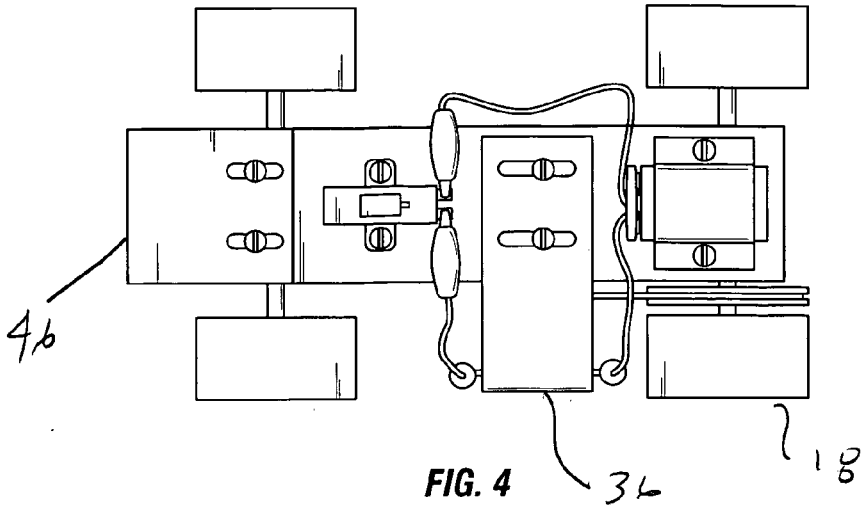
FIG. 4 shows a top view.

FIG. 4 which is the top view, better illustrates the alligator clip wires 50, 51 and 52. Note the positioning of the bracket which attaches the battery to the block or frame. The switch 40, of course can be a variety of configurations including one which is held in place by a separate bracket (not shown) similar to the bracket which holds the battery. As with the alligator clip leads, the battery is typically a 9 volt battery which can be purchased at any supermarket.

Figure 5:
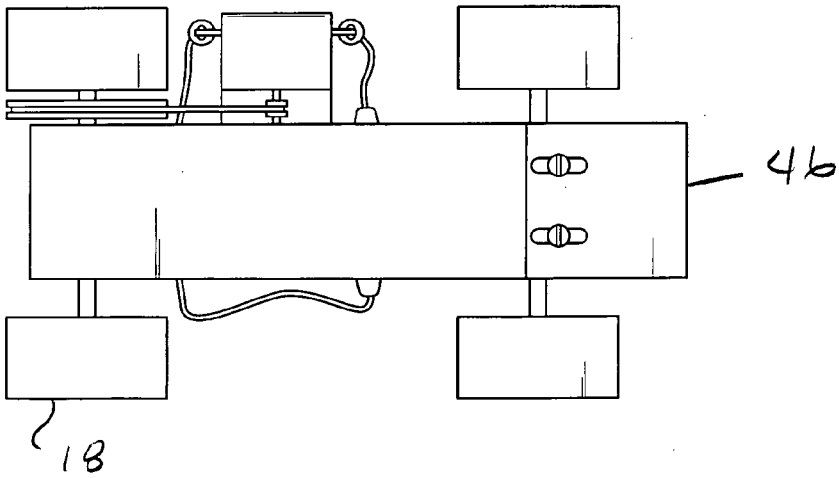
FIG. 5 shows a bottom view.
Figure 6:
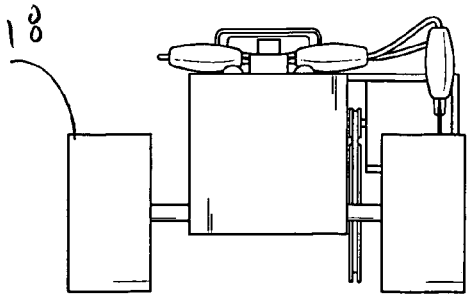
FIG. 6 shows a front view of the present invention.
Figure 7:
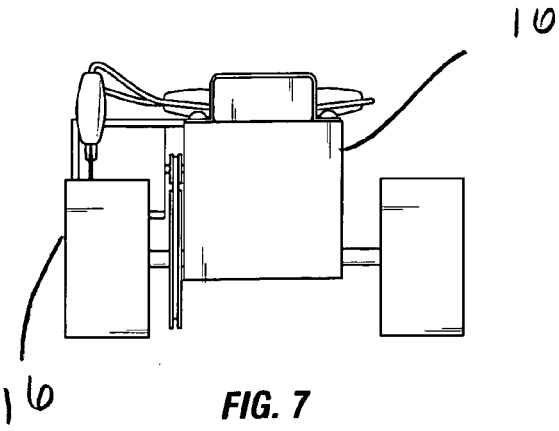
FIG. 7 shows a back view.

FIG. 5 shows a view from the bottom illustrating in detail how the motor is held in place by the motor mounting bracket and hole 54 and the pulley, and how the pulley run from the motor drive shaft to the rear wheels. FIGS. 5, 6 and 7 are bottom, front and rear views are shown as previously described.

As indicated previously, the preferred embodiment would have this invention sold as a kit which may include a combination of wheels, axels, pulleys, drive shaft, block, brackets, alligator clips, batteries, front fairing or bumper, and screws. Instructions with a description of how motors operate, how pulleys operate and how electric circuitry works would also be included.

While we have shown and described various embodiments in accordance with the present invention, it should be clear to those skilled in the art that further embodiments may be made without departing from the scope and spirit of this concept.

The invention claimed is:

1. A wheeled toy vehicle comprising:

a chassis having end walls, side walls, top and bottom walls and front and rear portions;

a front axle having first wheels mounted to each end thereof mounted to the front of the chassis for rolling rotation about a longitudinal axis thereof;

a rear axle having second wheels mounted to each end thereof for rolling rotation about a longitudinal axis thereof;

a battery compartment for supporting an electrical battery located on the top of said chassis;

an electric motor mounted on the side of said chassis by means of an L-shaped motor mounting bracket cantilevered and removeably connected to the top of the chassis;

electrical contact structure for selectively transmitting electric power from a battery in said battery compartment to said motor;

said electric motor having a drive shaft with a first driving pulley;

said rear axle having a driven pulley;

a belt drive connecting said first driving pulley to said driven pulley;

and whereby the chassis has a hole in its side for receiving one end of the drive shaft, and the motor and drive shaft is held in place by connection to said mounting bracket on one end and drive shaft being inserted into said hole in the chassis on the other.

* * * * *